US006498444B1

(12) United States Patent
Hanna et al.

(10) Patent No.: US 6,498,444 B1
(45) Date of Patent: Dec. 24, 2002

(54) COMPUTER-AIDED TUNING OF CHARGED PARTICLE ACCELERATORS

(75) Inventors: Samy Hanna, Danville, CA (US); Rod Loewen, Redwood City, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 09/546,409

(22) Filed: Apr. 10, 2000

(51) Int. Cl.[7] ..... H05H 9/00

(52) U.S. Cl. ..... 315/500; 315/505; 250/505.1; 250/492.3

(58) Field of Search ..... 315/505, 500; 250/505.1, 492.3

(56) References Cited

U.S. PATENT DOCUMENTS

H755 H * 3/1990 Karl, Jr. ..... 250/458.1
5,661,304 A * 8/1997 Kimura et al. ..... 250/397
5,734,168 A 3/1998 Yao ..... 250/492.3
5,933,335 A 8/1999 Hitchcock et al. ..... 363/25
5,982,101 A * 11/1999 Fremgen, Jr. et al. .. 315/111.91

* cited by examiner

*Primary Examiner*—Bruce Anderson
*Assistant Examiner*—Nikita Wells

(57) ABSTRACT

Systems and methods for tuning a charged particle accelerator (40) are described. An accelerator tuning system (44) includes a graphical user interface (110) that guides a tuning technician (42) through an accelerator tuning process and interfaces with a measurement instrument (46) configured to measure characteristic parameters of the accelerator (40). The graphical user interface (110) enables the technician (42) to make parameter measurements and interpret the results of those measurements more quickly and easily. A computer (50) may be programmed to generate the graphical user interface (110), and instructions (51) for generating the graphical user interface (110) may be carried on a computer-readable medium. An accelerator tuning method includes the steps of guiding a user through an accelerator tuning process and interfacing with a measurement instrument (46) configured to measure characteristic parameters of the accelerator (40).

29 Claims, 6 Drawing Sheets

COMPUTER-AIDED TUNING OF CHARGED PARTICLE ACCELERATORS

TECHNICAL FIELD

This invention relates to systems and methods for tuning charged particle accelerators.

BACKGROUND

Charged particle accelerators may be used in a variety of applications. For example, a charged particle accelerator may be used to generate a high-energy electron beam in a radiation therapy device. The electron beam may be applied directly to one or more therapy sites on a patient, or it may be used to generate photon (e.g., X-ray) beams for treating a patient. As shown in FIG. 1, a conventional charged particle accelerator 10 for use in a medical radiotherapy device includes a series of accelerating cavities 12, 14, 16 that are aligned along a beam axis 18. A particle source 20 (e.g., an electron gun) directs charged particles into accelerating cavity 12. As the charged particles travel through the succession of accelerating cavities 12–16, the particles are focused and accelerated by an applied electromagnetic field ("driving signal") that is applied by an external source 22. Typically, the resulting accelerated particle beam 24 is directed to a magnetic energy filter 26 that bends beam 24 by approximately 270°. A filtered output beam 28 is directed through a window 30 to a target 32 that generates a photon beam 34. Other kinds of charged particle accelerators are well known in the art.

The operating efficiency of a charged particle accelerator is optimized when the resonant frequency of the accelerator matches the frequency of the applied driving signal. Although the physical characteristics of the accelerator needed to achieve the desired resonant frequency may be determined precisely, imperfections in the accelerator cavity structure may result from variations in the accelerator manufacturing process. These imperfections tend to detune the accelerator cavity structure. As a result, accelerators generally must be tuned before they can be used in an operable device.

Accelerators may be tuned manually by a tuning technician who physically deforms the structure of each accelerator cavity until the desired resonant frequency is achieved. The accelerator tuning process, however, involves a number of complex steps. For example, for each cavity of the accelerator (including each accelerating cavity and any off-axis coupling cavities), a tuning technician must prepare the accelerator for a measurement (e.g., configure the accelerator so that the cavity to be measured is isolated from the other cavities), measure one or more tuning parameters with a measurement instrument, and modify (e.g., deform) the physical structure of the cavity until a desired resonant frequency is achieved. In sum, in order to successfully and efficiently tune an accelerator, the tuning technician must prepare the accelerator for a plurality of different measurements, and must interpret and respond to the resulting plurality of measurement values.

SUMMARY

The invention features a graphical user interface that guides a tuning technician through an accelerator tuning process and interfaces with a measurement instrument configured to measure characteristic parameters of the accelerator (e.g., a microwave or RF instrument, such as a network analyzer, a spectrum analyzer or a frequency counter) to enable the technician to make parameter measurements and interpret the results of those measurements more quickly and easily. In one aspect of the invention, a computer is programmed to generate the graphical user interface. In another aspect of the invention, a computer-readable medium carries instructions for generating the graphical user interface.

As used herein the term "computer" is intended to broadly refer to any programmable device that can respond to and execute a specific set of instructions (e.g., a program) in a well-defined manner. The term "interfacing" is intended to broadly refer to the ability of two devices to communicate with each other.

In one embodiment, the graphical user interface is configured to display instructions for preparing the accelerator for a tuning parameter measurement by a measurement instrument. The graphical user interface may be configured to display the measurement preparation instructions pictorially or textually, or both. The graphical user interface preferably is configured to display tuning parameter values corresponding to measurements made before and after the accelerator has been tuned.

The graphical user interface may be configured to receive a user input and to generate a measurement command signal in response to the received user input. The graphical user interface also may be configured to display a tuning status indicator. The tuning status indicator may include a list of checkpoints in the accelerator tuning process.

The computer may be programmed to generate a second graphical user interface for displaying dynamic feedback information related to a measured tuning parameter (e.g., the resonant frequency of a cavity). The displayed dynamic feedback information preferably includes a representation of the difference between a measured tuning parameter value and a preselected tuning parameter value. The parameter value difference may be represented pictorially or numerically.

In one embodiment, the graphical user interface is configured to guide the user through a process of measuring one or more quality assurance parameter values, and the computer is programmed to store in memory the measured quality assurance parameter values and an associated accelerator identifier.

The invention also features an accelerator tuning method that includes the steps of guiding a user through an accelerator tuning process and interfacing with a measurement instrument configured to measure characteristic parameters of the accelerator.

Among the advantages of the invention are the following. The invention enables tuning technicians to tune accelerators in less time and with a greater accuracy than prior accelerator tuning approaches. In addition, the invention enables technicians to tune accelerators with significantly less training than prior approaches, reducing the considerable cost of developing and implementing elaborate accelerator tuning training programs.

Other features and advantages of the invention will become apparent from the following description, including the drawings and the claims.

DETAILED DESCRIPTION

Figure 1:
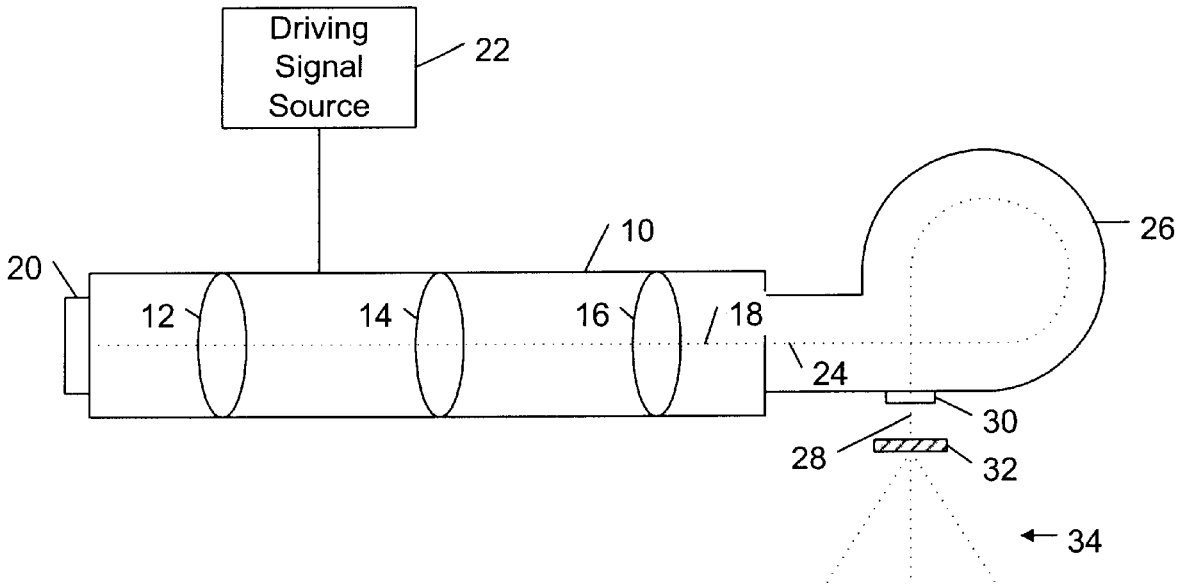
FIG. 1 (Prior Art)
FIG. 1 is a diagrammatic view of a conventional charged particle accelerator.
Figure 2:
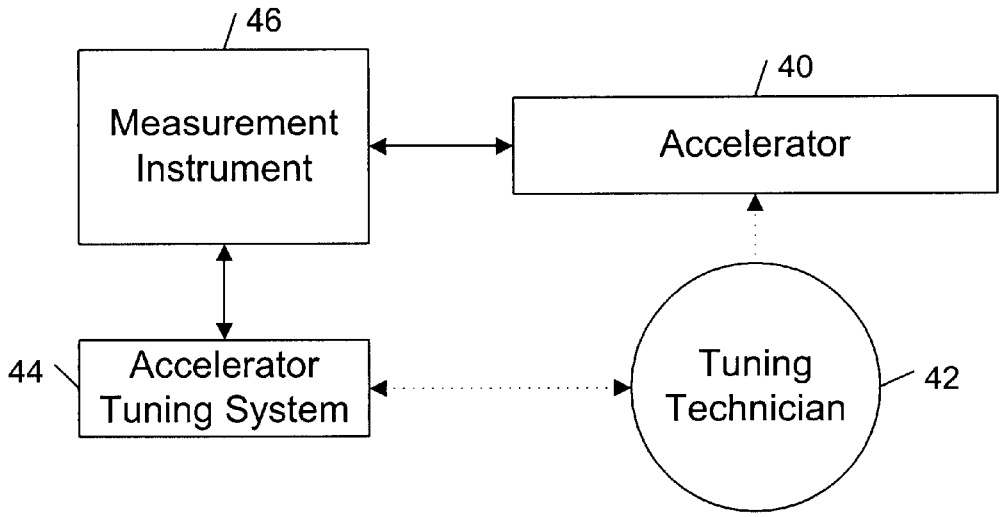
FIG. 2 is a block diagram of an accelerator, an accelerator tuning system, a measurement instrument and a tuning technician.

Referring to FIG. 2, a newly manufactured accelerator 40 may be tuned by a tuning technician 42 who is guided through an accelerator tuning process by an accelerator tuning system 44 that interfaces with a measurement instrument 46 (e.g., a microwave or RF measurement instrument, such as a HP 8719 network analyzer available from Agilent Technologies, Inc. of Palo Alto, Calif.). The accelerator tuning process may include one or more of the following steps: verifying the calibration of measurement instrument 46; measuring one or more tuning parameters before the accelerator has been tuned; performing an initial tuning of accelerator 40; performing a final tuning of accelerator 40; and measuring characteristic accelerator tuning parameters after the accelerator has been finally tuned. Accelerator tuning system 44 is configured to display instructions for preparing accelerator 40 for a tuning parameter measurement. Such instructions may include a description of how to isolate a particular cavity to be measured and a description of how to connect measurement instrument 46 to accelerator 40. The measurement preparation instructions are displayed both pictorially and textually. After technician 42 has followed the measurement preparation instructions and indicated that a measurement should be made, accelerator tuning system 44 generates a measurement command signal that configures measurement instrument 46 (e.g., sets the measurement sweep rate) and triggers a tuning parameter measurement by measurement instrument 46. Accelerator tuning system 44 also displays the measured tuning parameter values (e.g., the resonant frequencies of the accelerator cavities) so that technician 42 may evaluate the characteristic properties of accelerator 40.

Figure 3:
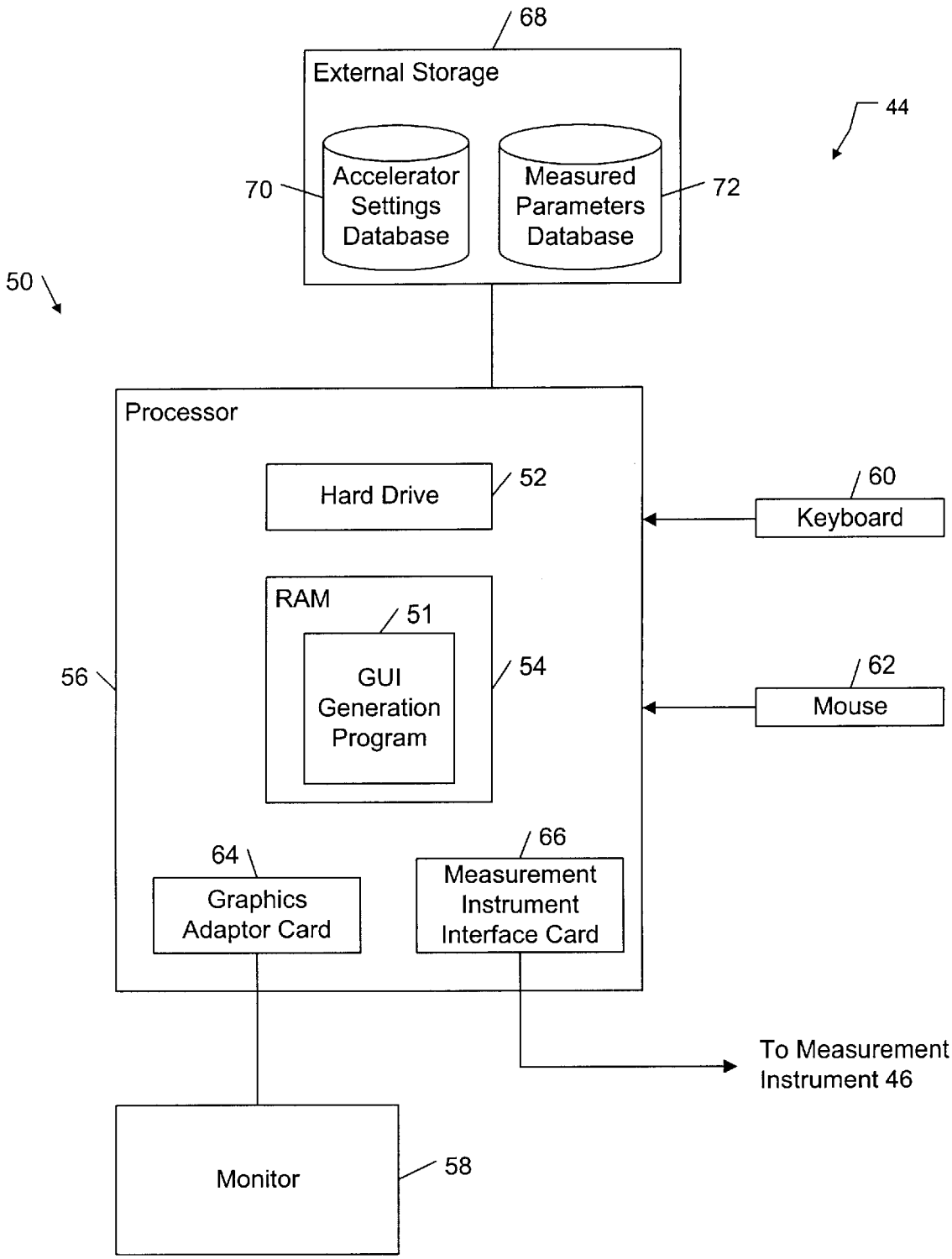
FIG. 3 is a block diagram of an accelerator tuning system that includes a computer programmed to generate a graphical user interface for guiding a technician through an accelerator tuning process and interfacing with a measurement instrument.

Referring to FIG. 3, in one embodiment, accelerator tuning system 44 includes a computer 50 (e.g., a general or special purpose programmable computer) that is programmed with a set of instructions 51 (e.g., a graphical user interface generation program). The instructions 51 may be stored in a physical medium, e.g., a hard drive 52 or a random access memory (RAM) 54, and are executable by a central processor 56. Computer 50 is configured to generate one or more graphical user interface windows (or screens) on a monitor 58 for guiding tuning technician 42 through an accelerator tuning process, interfacing with measurement instrument 46, and displaying the results of tuning parameter measurements. A keyboard 60 and a mouse 62 enable the tuning technician to interact with the graphical user interfaces. A graphics adapter card 64 generates the one or more graphical user interface windows on monitor 58. Computer 50 interfaces with measurement instrument 46 through an interface card 66. Computer 50 also includes an external mass storage device 68 (e.g., a disk drive or a tape drive) containing a storage medium (e.g., a CD ROM, a hard disk, a magnetic diskette or a magnetic tape) for storing an accelerator settings database 70 and a measured parameters database 72, both of which are described in detail below. Databases 70, 72 also may be stored locally on hard drive 52 or a hard drive on a network server to which computer 50 is connected. As used herein, the term "database" refers to any collection of information stored in a way that can be retrieved by a computer program.

In operation, tuning system 44 generates one or more graphical user interfaces to assist a tuning technician to evaluate and tune accelerator 40. The graphical user interfaces display explicit instructions and diagrams that lead the technician through the tuning process while tuning system 44 remotely configures and retrieves measurement values from measurement instrument 46.

Measurement settings (e.g., target tuning values and measurement sweep parameters) may be changed only by privileged users. Measured data (e.g., voltage standing wave ratio values, transmission values, and other cell tuning data) are saved in a folder that is cross-referenced to a unique identifier (e.g., a serial number) that is assigned to each accelerator. The graphical user interfaces are formatted in accordance with the particular type of accelerator to be tuned. Tuning system 44 also incorporates various error checking features, e.g., renaming data files if a file name conflict occurs, verifying that the measurement instrument has been calibrated, verifying tuning resonance values, prompting the technician to re-measure questionable values, and automatically saving measurement data.

Figure 4:
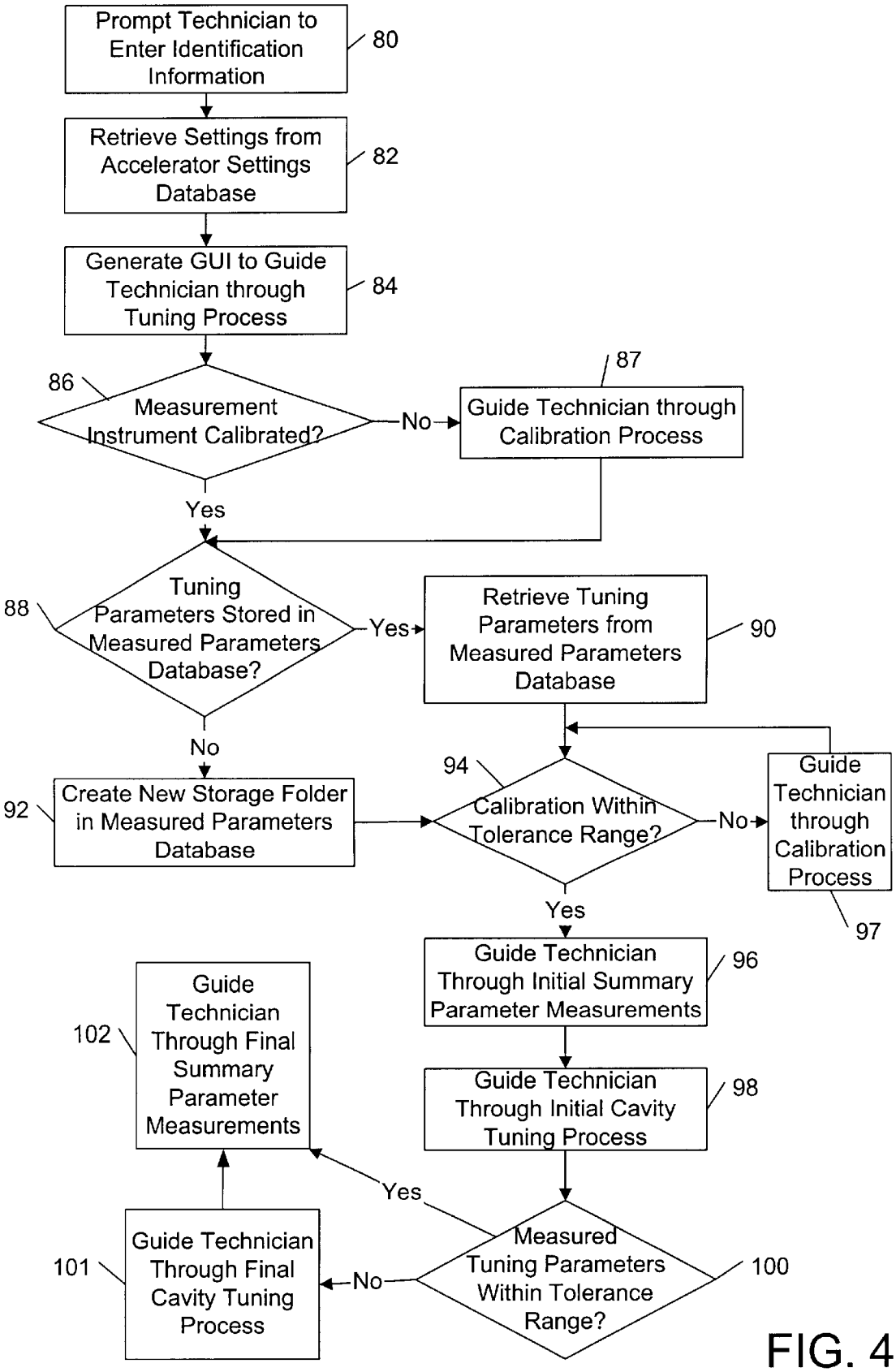
FIG. 4 is a flow diagram of an accelerator tuning method.

Referring to FIG. 4, in one embodiment, tuning system 44 may choreograph an accelerator tuning process as follows. Initially, technician 42 is prompted to enter prescribed identification information, such as the technician's identification number, the date, the kind of accelerator to be tuned, and the serial number of the accelerator to be tuned (step 80). Based upon the accelerator-type information entered by technician 42, accelerator tuning settings are retrieved from accelerator settings database 70 (step 82). These settings determine the format of the graphical user interfaces and the specific tuning instructions and diagrams that are displayed to guide technician 42 through the tuning process. A measurement preparation and summary graphical user interface (GUI) is generated and displayed in a window on monitor 58 to guide technician 42 through the tuning process (step 84). As explained in detail below in connection with FIGS. 5 and 6, the graphical user interface includes areas displaying textual and pictorial measurement instructions, and displaying an indication of the status of the accelerator tuning process. The graphical user interface also includes areas displaying various tuning parameter values that were measured by measurement instrument 46. Tuning system 44 then determines whether measurement instrument 46 has been calibrated (step 86). If not, the graphical user interface guides the technician through the process of calibrating measurement instrument 46 (step 87).

If the serial number entered by technician 42 corresponds to an accelerator that has been partially tuned (step 88), the previously measured tuning parameter values are retrieved from measured parameters database 72 and displayed in an area of the graphical user interface (step 90). If the serial number corresponds to an accelerator that has not been previously tuned, a new folder (or file) is created in the measured parameters database 72 to store the results of the tuning parameter measurements that will be made (step 92). In this embodiment, the technician is not allowed to re-tune accelerators that have been finally tuned.

If the measurement instrument calibration is within a preselected calibration tolerance range (step 94), tuning technician 42 is guided through an initial measurement of several summary parameters that will characterize the untuned accelerator (step 96). Otherwise, tuning technician 42 is prompted to recalibrate measurement instrument 46 (step 97). In another embodiment, technician 42 may skip the measurement instrument calibration procedure until the final stage of the tuning process. Tuning technician 42 is guided through the process of tuning each accelerator cavity to a preselected initial resonant frequency (step 98). If the difference between the measured resonant frequency and a preselected target value is not within a preselected tolerance range (step 100), technician 42 is guided through the steps of tuning each accelerator cavity to a preselected final resonant frequency (step 101). Finally, tuning technician 42 is guided through a final measurement of summary parameters that will characterize the tuned accelerator (step 102).

Figure 5:
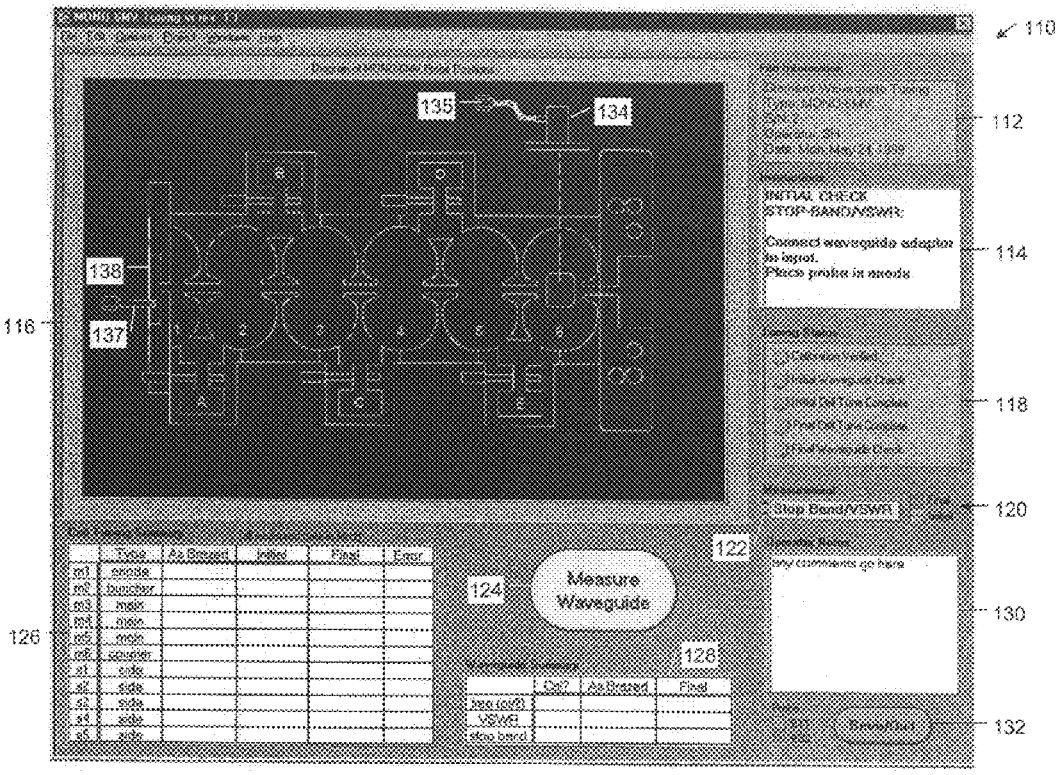
FIG. 5 is a diagrammatic view of a graphical user interface displaying instructions for guiding a tuning technician through a tuning parameter measurement for an entire accelerator structure.

As shown in FIG. 5, a measurement preparation and summary graphical user interface 110 is generated by processor 56 and is displayed on monitor 58 as a window. Graphical user interface 110 includes a plurality of display areas 112, 114, 116, 118, 120, 126 and 130. File Information area 112 displays the identification information entered by tuning technician 42 (see step 80 above). Instructions area 114 displays a textual description of the measurement preparation instructions corresponding to the current step of the accelerator tuning process. The instructions shown in FIG. 5 ("Connect network adaptor to input. Place probe in anode.") correspond to the instructions for measuring summary parameters characteristic of accelerator 40. Measurement preparation instructions also are displayed pictorially in Diagram area 116. The image shown in FIG. 5 corresponds to a diagrammatic cross-sectional view of accelerator 40 with an accelerator adaptor 134 coupled to an input 135 of measurement instrument 46 and a measurement probe 137 positioned in the anode 138 of accelerator 40. The Tuning Status area 118 displays an indication of how far the tuning technician has progressed through the accelerator tuning process. The tuning status indicator shown in FIG. 5 consists of a list of checkpoints or milestones ("Calibration Verified," "Initial Network Check," "Initial Cell Tune Complete," "Final Cell Tune Complete," and "Final Network Check") in the tuning process. After the technician has completed the steps up to a particular checkpoint, a box adjacent to that checkpoint is marked (e.g., by a change in color) to indicate that the stages in the tuning process up to that checkpoint have been completed. The Measurement display area 120 displays a description of the current measurement to be performed (e.g., "Stop Band/VSWR"), and an indication of whether the measurement corresponds to the "Initial" or "Final" stage of the tuning process (in FIG. 5, the "Initial" box is marked to indicate that the measurement is being made before the accelerator has been finally tuned). Measurement display area 120 also includes a scroll bar 122 that enables tuning technician 42 to select the kind of measurement to be performed.

After technician 42 has followed the instructions displayed in areas 114 and 116, the technician may select measurement icon 124 (labeled "Measure Network") to trigger a measurement. In response to the technician's selection of measurement icon 124, accelerator tuning system 44 configures measurement instrument 46, initiates the appropriate tuning parameter measurement, and retrieves the measurement results. Depending upon the kind of measurement performed, the measurement results are displayed in either Cell Tuning Summary table 126 or Network Summary table 128. Cell Tuning Summary table 126 displays the tuning parameter values corresponding to each of the cavity structures (or cells) of accelerator 40 for three different stages in the tuning process: before the accelerator has been tuned ("As Brazed"), after the initial tuning process ("Initial"), and after the final tuning process ("Final"). Cell Tuning Summary table 126 also displays the difference ("Error") between the final tuning parameter values and the desired tuning parameter values. The resonant frequency ("freq pi/2"), the voltage standing wave ratio ("VSWR") and the stop band frequency ("stop band") for the overall accelerator structure are measured before the accelerator has been tuned ("As Brazed") and after the final tuning process ("Final"); these quality assurance values (or summary statistics) are displayed in Network Summary table 128. Network Summary table 128 also displays an indication ("Cal?") of whether measurement instrument 46 has been appropriately calibrated.

Tuning technician 42 may enter notes or comments in the Operator Notes area 130. Tuning technician 42 may save the measurement results for the current tuning session and quit the accelerator tuning process by selecting the Save/Quit icon 132.

Figure 6:
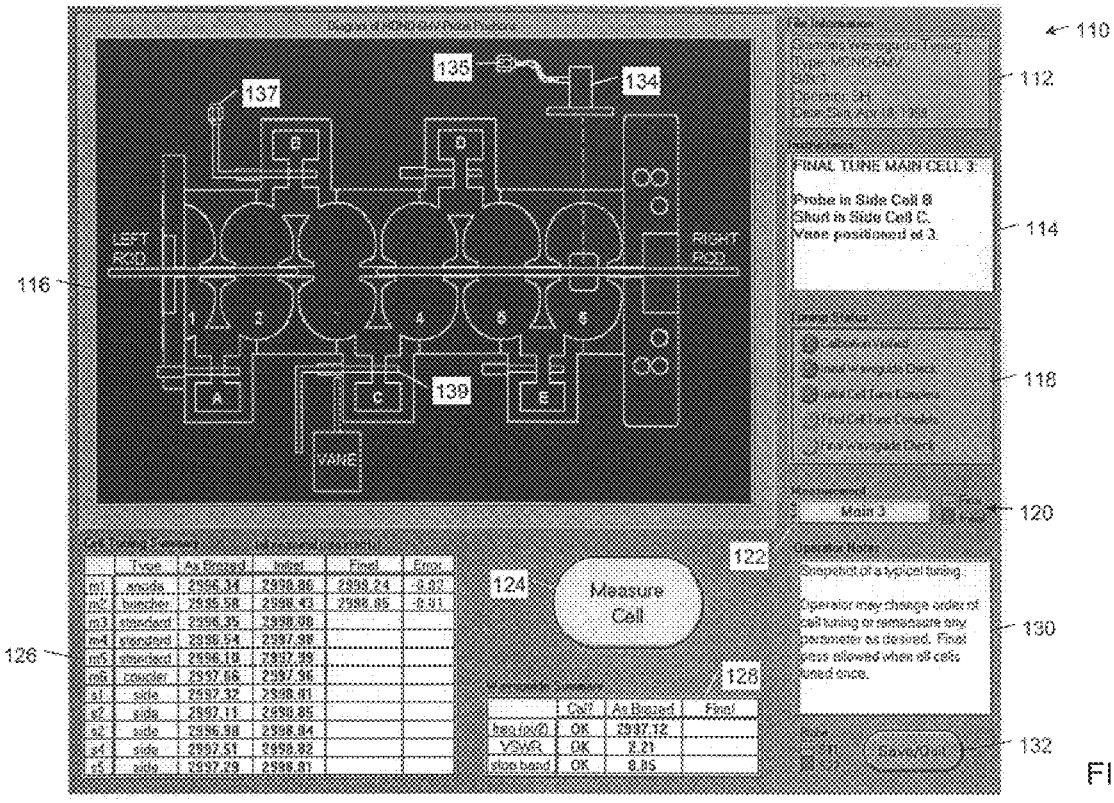
FIG. 6 is a diagrammatic view of the graphical user interface of FIG. 5 displaying instructions for guiding a tuning technician through a tuning parameter measurement for a single cavity of an accelerator.

Referring to FIG. 6, after tuning technician 42 has gone through the initial tuning process (see step 98 above), graphical user interface 110 guides the technician through the final tuning process (see step 101 above). For example, to finally tune main cell 3 of accelerator 40, graphical user interface 110 displays in the Instructions area 114 the instructions "Probe in side cell B. Short in side cell C. Vane positioned at 3." Graphical user interface 110 also displays in Diagram area 116 the positions of measurement instrument input 135, measurement probe 137, a short 139 in cell C, a measurement vane, and left and right cavity isolation rods.

Figure 7:
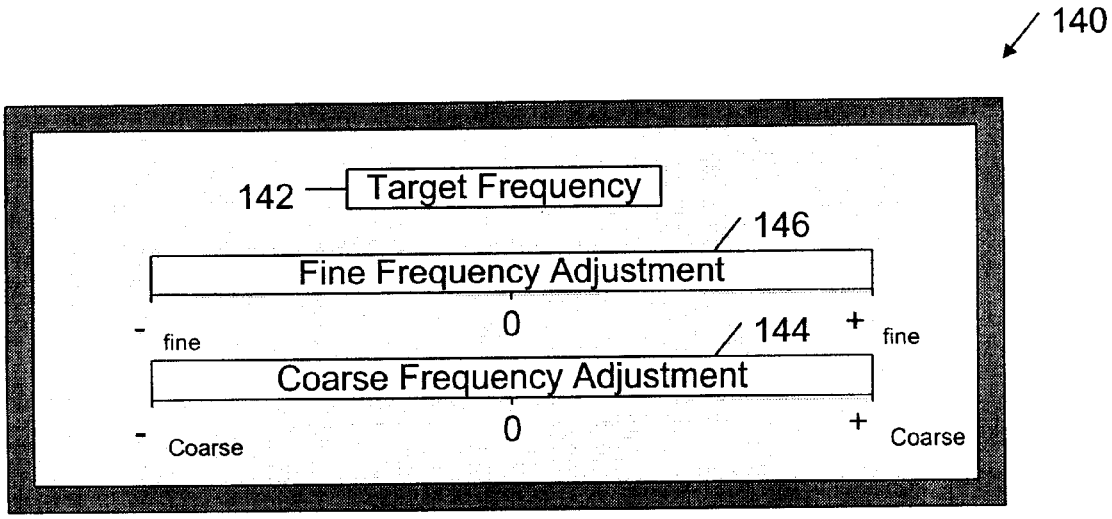
FIG. 7 is a diagrammatic view of a graphical user interface displaying dynamic feedback information related to a measured tuning parameter.

As shown in FIG. 7, after tuning technician 42 has prepared accelerator 40 for a measurement and has selected measurement icon 124, tuning system 44 generates a measurement feedback graphical user interface 140 that displays dynamic feedback information related to the measured tuning parameter value. Graphical user interface 140 includes a measurement value area 142, a coarse adjustment area 144, and a fine adjustment area 146. Measurement value area 142 displays the current value of the measured tuning parameter. Coarse adjustment area 142 displays the difference between the measured tuning parameter value and a preselected target parameter value; this difference is displayed as a bar graph that ranges from $-\Delta_{Coarse}$ to $+\Delta_{Coarse}$. Fine adjustment area 144 displays the difference between the measured parameter value and the target value as a bar graph that ranges from $-\delta_{fine}$ to $+\delta_{fine}$. In operation, the technician may easily evaluate the degree to which the measured cavity must be tuned, and may easily observe the impact of any modifications (e.g., deformations) made to the accelerator cavity structure. Graphical user interface 140 provides an intuitive and palpable indication of the tuning characteristics of the accelerator cavity in a way that enables the technician to readily ascertain the amount of modification needed to achieve the target resonant frequency. This feature enables the technician to tune accelerators more quickly and with greater accuracy.

The measurement information stored in measured parameters database 72, particularly the accelerator characterizing summary parameters (resonant frequency, VSWR, and stop band values), may be used in a manufacturing quality assurance process. The stored summary parameters provide an indication of the quality of the accelerators and, thus, the quality of the manufacturing process. Therefore, the summary parameters may be used to identify a potential problem with the manufacturing process. If an accelerator is found to be of particularly low quality, the historical measurement data may be used to track down the cause of the problem. For example, the "As Brazed" measurement data for the accelerator cavities may indicate that the resonant frequencies of one or more of the cells is significantly different from the desired values. Using the accelerator serial number, a quality assurance manager can cross-reference this historical data to information collected at various stages of the manufacturing process (e.g., the machining and brazing stages) to determine the cause of the manufacturing defect.

The systems and methods described herein are not limited to any particular hardware or software configuration, but rather they may be implemented in any computing or processing environment in which graphic content may be created. The graphical user interface generation program preferably is implemented in a high level procedural or object oriented programming language; however, the program may be implemented in assembly or machine language, if desired. In any case, the programming language may be a compiled or interpreted language. In one embodiment, the various graphical user interface generation program described above was written using the LABVIEW programming platform, which is available from National Instruments Corporation of Austin, Tex.

The graphical user interfaces described above may be used to tune and evaluate a variety of different kinds of charged particle accelerators including, but not limited to, waveguide-based accelerators for use in radiation therapy devices.

Other embodiments are within the scope of the claims.

What is claimed is:

1. A system for tuning an accelerator, comprising a computer programmed to generate a graphical user interface for guiding a user through an accelerator tuning process and interfacing with a measurement instrument configured to measure characteristic parameters of the accelerator.

2. The system of claim 1, wherein the graphical user interface is configured to display instructions for preparing the accelerator for a tuning parameter measurement by the measurement instrument.

3. The system of claim 2, wherein the graphical user interface is configured to display the measurement preparation instructions pictorially.

4. The system of claim 2, wherein the graphical user interface is configured to display the measurement preparation instructions textually.

5. The system of claim 1, wherein the graphical user interface is configured to display tuning parameter values corresponding to measurements made before and after the accelerator has been tuned.

6. The system of claim 1, wherein the graphical user interface is configured to receive a user input and to generate a measurement command signal in response to the received user input.

7. The system of claim 1, wherein the graphical user interface is configured to display a tuning status indicator.

8. The system of claim 7, wherein the tuning status indicator includes a list of checkpoints in the accelerator tuning process.

9. The system of claim 1, wherein the computer is programmed to generate a second graphical user interface for displaying dynamic feedback information related to a measured tuning parameter.

10. The system of claim 9, wherein the displayed dynamic feedback information includes a representation of the difference between a measured tuning parameter value and a preselected tuning parameter value.

11. The system of claim 10, wherein the parameter value difference is represented pictorially.

12. The system of claim 10, wherein the parameter value difference is represented numerically.

13. The system of claim 1, wherein the graphical user interface is configured to guide the user through a process of measuring one or more quality assurance parameter values, and the computer is programmed to store in memory the measured quality assurance parameter values and an associated accelerator identifier.

14. The system of claim 1, wherein the graphical user interface is configured to interface with a measurement instrument selected from the group consisting of a network analyzer, a spectrum analyzer, and a frequency counter.

15. A method of tuning an accelerator, comprising guiding a user through an accelerator tuning process and interfacing with a measurement instrument configured to measure characteristic parameters of the accelerator.

16. The method of claim 15, wherein the step of guiding the user comprises displaying instructions for preparing the accelerator for a tuning parameter measurement by the measurement instrument.

17. The method of claim 16, wherein the measurement preparation instructions are displayed pictorially.

18. The method of claim 16, wherein the measurement preparation instructions are displayed textually.

19. The method of claim 15, further comprising displaying tuning parameter values corresponding to measurements made before and after the accelerator has been tuned.

20. The method of claim 15, further comprising receiving a user input and generating a measurement command signal in response to the received user input.

21. The method of claim 15, further comprising displaying a tuning status indicator.

22. The method of claim 21, wherein the tuning status indicator includes a list of checkpoints in the accelerator tuning process.

23. The method of claim 15, further comprising displaying dynamic feedback information related to a measured tuning parameter.

24. The method of claim 23, wherein the displayed dynamic feedback information includes a representation of the difference between a measured tuning parameter value and a desired tuning parameter value.

25. The method of claim 24, wherein the parameter value difference is represented pictorially.

26. The method of claim 24, wherein the parameter value difference is represented numerically.

27. The method of claim 15, wherein the step of guiding the user comprises guiding the user through a process of measuring one or more quality assurance parameter values, and further comprising storing in memory the measured quality assurance parameter values and an associated accelerator identifier.

28. The method of claim 15, wherein the interfacing step comprises interfacing with a measurement instrument selected from the group consisting of a network analyzer, a spectrum analyzer, and a frequency counter.

29. A computer-readable medium carrying instructions for generating a graphical user interface for guiding a tuning technician through an accelerator tuning process and interfacing with a measurement instrument configured to measure characteristic parameters of the accelerator.

* * * * *